US006598578B2

(12) United States Patent
Takahashi et al.

(10) Patent No.: US 6,598,578 B2
(45) Date of Patent: Jul. 29, 2003

(54) LUBRICATING STRUCTURE IN INTERNAL COMBUSTION ENGINE

(75) Inventors: Masayuki Takahashi, Wako (JP); Toshihiro Akiwa, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/989,686

(22) Filed: Nov. 21, 2001

(65) Prior Publication Data

US 2002/0062811 A1 May 30, 2002

(30) Foreign Application Priority Data

Nov. 22, 2000 (JP) ..... 2000-355905

(51) Int. Cl.[7] ..... F01M 1/00
(52) U.S. Cl. ..... 123/196 R
(58) Field of Search ..... 123/90.33, 90.44, 123/90.39, 196 R, 90.16, 90.15, 90.17, 90.27

(56) References Cited

U.S. PATENT DOCUMENTS 4,883,027 A * 11/1989 Oikawa et al. ..... 123/90.16
6,302,071 B1 * 10/2001 Kobayashi ..... 123/90.17

FOREIGN PATENT DOCUMENTS

JP 7-7524 2/1995

* cited by examiner

*Primary Examiner*—Henry C. Yuen
*Assistant Examiner*—Hyder Ali
(74) *Attorney, Agent, or Firm*—Arent Fox Kintner Plotkin & Kahn, PLLC

(57) ABSTRACT

In an internal combustion engine including a rocker shaft holder which comprises a plurality of shaft-supporting sections connected together and disposed at distances in a direction of arrangement of cylinders and which is fixed to a cylinder head, and rocker shafts each of which swingably carries thereon a plurality of rocker arms and which are supported by the shaft-supporting sections, an oil sump is defined in an upper surface of the rocker shaft holder, and lubricating oil passages are provided in the rocker shaft holder to communicate with the oil sump, so that a lubricating oil can be supplied to slide portions of at least some of the rocker arms. Thus, an increase in number of parts can be avoided in the lubrication of the slide portions of at least some rocker arms.

14 Claims, 12 Drawing Sheets

LUBRICATING STRUCTURE IN INTERNAL COMBUSTION ENGINE

BACKGROUND OF THE INVENTION

1. Field of the Invention

The present invention relates to an improvement of a lubricating structure in an internal combustion, and particularly of an internal combustion, comprising a rocker shaft holder which comprises a plurality of shaft-supporting sections disposed at distances in a direction of arrangement of cylinders and connected together and which is fixed to a cylinder head, and rocker shafts each of which has a plurality of rocker arms swingably carried thereon and which are supported by the shaft-supporting sections, as well as of an internal combustion comprising rocker shafts each of which has a plurality of rocker arms swingably carried therein and which are supported on a rocker shaft holder fixed to a cylinder head, valve-operating characteristic changing mechanisms provided in the rocker arms and capable of changing the operating characteristic for engine valves by changing the hydraulic pressure, and a hydraulic pressure control valve unit mounted to the cylinder head for controlling the pressure of a working oil supplied to working oil passages defined in the rocker shafts to lead to the valve-operating characteristic changing mechanisms.

2. Description of the Related Art

Such a rocker arm lubricating structure in an internal combustion engine is conventionally known, for example, from Japanese Utility Model Publication No. 7-7524.

In the prior art disclosed in the above Japanese Utility Model, a pipe member extending in a direction of arrangement of cylinders is fixedly dispose above a valve-operating mechanism to guide a lubricating oil to slide portions of rocker arms, so that the lubricating oil is dropped from the pipe member to the valve-operating mechanism located below the pipe member. Therefore, the lubricating pipe member is required, resulting in an increase in number of parts.

SUMMARY OF THE INVENTION

Accordingly, it is an object of the present invention to provide a lubricating structure in a multi-cylinder internal combustion engine, wherein an increase in number of parts is avoided in the lubrication of slide portions of at least some of the rocker arms.

To achieve the above object, according to a first aspect and feature of the present invention, there is provided a lubricating structure in an internal combustion engine, comprising a rocker shaft holder which comprises a plurality of shaft-supporting sections connected together and disposed at distances in a direction of arrangement of cylinders and which is fixed to a cylinder head; and rocker shafts each of which swingably carries thereon a plurality of rocker arms and which are supported by said shaft-supporting sections, wherein said rocker shaft holder has an oil sump defined on its upper surface, and has lubricating oil passages communicating with said oil sump so that a lubricating oil can be supplied to slide portions of at least some of said rocker arms.

With such arrangement of the first feature, the oil accumulated in the oil sump in the upper surface of the rocker shaft holder integrally provided with the plurality shaft-supporting sections for supporting the rocker shaft and fixed to the cylinder head can be reliably supplied from the oil sump through the lubricating oil passages to the slide portions of at least some of the rocker arms to positively lubricate the slide portions of at least some of the rocker arms. Therefore, a part exclusively for lubricating the slide portions of at least some of the rocker arms is not required and hence, the slide portions of the rocker arms can be lubricated, while avoiding an increase in number of parts. Moreover, the oil sump is defined in the upper surface of the rocker shaft holder and hence, can be formed easily.

According to a second aspect and feature of the present invention, in addition to the first feature, said oil sump having a groove portion extending in the direction of arrangement of the cylinders is defined in the upper surface of said rocker shaft holder fixed to the cylinder head inclined to left or right in said direction of arrangement of the cylinders; said rocker shaft holder has a rib projectingly provided on its upper surface at a position below said groove portion to extend in the direction of arrangement of the cylinders; and said lubricating oil passages with their upper ends communicating with a portion of said oil sump closer to said rib are provided in said rocker shaft holder to extend through said rocker shaft holder along a side face of said rib adjacent said oil sump. With such arrangement, it is possible to compensate for a reduction in rigidity of the rocker shaft holder due to the provision of the lubricating oil passages, while enabling the supplying of the oil in the oil sump to the cylinders. Moreover, the rib can function as a wall defining a lower portion of the oil sump, whereby a larger amount of the oil can be positively stored on the upper surface of the rocker shaft holder.

According to a third aspect and feature of the present invention, in addition to the second feature, the lubricating structure further includes valve-operating characteristic changing mechanisms provided in said rocker arms and capable of changing the valve-operating characteristic for engine valves by changing the hydraulic pressure, and a hydraulic control valve unit mounted to the cylinder head to be able to control the pressure of the working oil supplied to said valve-operating characteristic changing mechanisms so that a drain oil discharged from said hydraulic control valve unit is guided to said oil sump. With such arrangement, the drain oil discharged from the hydraulic control valve unit is also passed to the slide portions of the rocker arms and utilized to lubricate the slide portions.

According to a fourth aspect and feature of the present invention, in addition to the first feature, at least a portion of said oil sump defined in the upper surface of said rocker shaft holder fixed to the cylinder head inclined to left or right in said direction of arrangement of the cylinders is defined by a plurality of bottomed cylindrical tubes integrally provided on said rocker shaft holder with lost motion springs accommodated therein for biasing some of the rocker arms; and a rib integrally provided on said rocker shaft holder to connect said bottomed cylindrical tubes together at a lower side in a direction of inclination of the cylinder head, and said lubricating oil passages are provided in said rocker shaft holder with their upper ends communicating with said oil sump in a region surrounded by the plurality of bottomed cylindrical tubes and said rib.

With such arrangement of the fourth feature, the connection of the plurality of bottomed cylindrical tubes to one another by the rib can contribute to an increase in rigidity of the rocker shaft holder, and define at least a portion of the oil sump on the upper surface of the rocker shaft holder. Moreover, the upper ends of the lubricating oil passages are put into communication with portions having the increased rigidity and hence, it is possible to avoid a reduction in rigidity of the rocker shaft holder due to the provision of the lubricating oil passages.

According to a fifth aspect and feature of the present invention, in addition to the fourth feature, the lubricating structure further includes valve-operating characteristic changing mechanisms provided in said rocker arms and capable of changing the valve-operating characteristic for engine valves by changing the hydraulic pressure, and a hydraulic control valve unit mounted to the cylinder head to be able to control the pressure of the working oil supplied to said valve-operating characteristic changing mechanisms so that a drain oil discharged from said hydraulic control valve unit is guided to said oil sump. In addition, according to a sixth aspect and feature of the present invention, in addition to the first feature, the lubricating structure further includes valve-operating characteristic changing mechanisms provided in said rocker arms and capable of changing the valve-operating characteristic for engine valves by changing the hydraulic pressure, and a hydraulic control valve unit mounted to the cylinder head to be able to control the pressure of the working oil supplied to said valve-operating characteristic changing mechanisms so that a drain oil discharged from said hydraulic control valve unit is guided to said oil sump.

With such arrangements of the fifth and sixth features, the drain oil discharged from the hydraulic pressure control valve unit can be also guided to the slide portions of the rocker arms and utilized for the lubrication of them.

According to a seventh aspect and feature of the present invention, in addition to the first feature, the lubricating structure further includes valve-operating characteristic changing mechanisms provided in said rocker arms and capable of changing the valve-operating characteristic for engine valves by changing the hydraulic pressure, and a hydraulic control valve unit mounted to the cylinder head for controlling the pressure of the working oil supplied to working oil passages defined in said rocker shafts to lead to said valve-operating characteristic changing mechanisms, and said oil sump enabling the drain oil to flow from said hydraulic pressure control valve unit is defined in the upper surface of the rocker shaft holder so that the lubricating oil can be supplied to the slide portions of at least some of said rocker arms.

With such arrangement of the seventh feature, the drain oil discharged from the hydraulic pressure control valve unit is supplied to the slide portions of at least some of the rocker arms via the oil sump in the rocker shaft holder supporting the rocker shafts. Therefore, a part exclusively for lubricating the slide portions of at least some of the rocker arms is not required and hence, the slide portions of the rocker arms can be lubricated, while avoiding an increase in number of parts. Moreover, the oil sump is defined in the upper surface of the rocker shaft holder and hence, can be formed easily.

According to an eighth aspect and feature of the present invention, in addition to the seventh feature, the lubricating structure further includes a passage-defining member interposed between said hydraulic pressure control valve unit and said rocker shaft holder, and having communication passages interconnecting said hydraulic pressure control valve unit and said working oil passages, an upper portion of said passage-defining member being formed to be able to deliver the drain oil discharged from said hydraulic pressure control valve unit to said oil sump. With such arrangement, the drain oil discharged from the hydraulic pressure control valve unit is supplied from the passage-defining member to the oil sump in the rocker shaft holder and hence, a part exclusively for delivering the drain oil between the hydraulic pressure control valve unit and the oil sump is not required.

According to a ninth aspect and feature of the present invention, in addition to the eighth feature, the upper portion of said passage-defining member is provided with a recess adapted to receive the drain oil from said hydraulic pressure control valve unit, and a guide for guiding the drain oil accumulated in said recess toward said oil sump, said guide being extending from said passage-defining member to above said oil sump. With such arrangement, the drain oil can be reliably delivered from the passage-defining member to the oil sump in the rocker shaft holder. Thus, a sufficient amount of the drain oil can be supplied to the oil sump to perform the sufficient lubrication.

To achieve the above object, according to a tenth aspect and feature of the present invention, there is provided a lubricating structure in an internal combustion engine comprising rocker shafts each of which has a plurality of rocker arms swingably carried therein and which are supported on a rocker shaft holder fixed to a cylinder head, valve-operating characteristic changing mechanisms provided in the rocker arms and capable of changing the operating characteristic for engine valves by changing the hydraulic pressure, and a hydraulic pressure control valve unit mounted to the cylinder head for controlling the pressure of a working oil supplied to working oil passages defined in the rocker shafts to lead to the valve-operating characteristic changing mechanisms, wherein the rocker shaft holder has an oil sump defined in its upper surface to enable a drain oil from the hydraulic pressure control valve unit to flow, so that a lubricating oil can be supplied to slide portions of at least some of the rocker arms.

With such arrangement of the tenth feature, the drain oil discharged from the hydraulic pressure control valve unit is supplied to the slide portions of at least some of the rocker arms via the oil sump in the rocker shaft holder supporting the rocker shafts. Therefore, a part exclusively for lubricating the slide portions of at least some of the rocker arms is not required and thus, the slide portions of the rocker arms can be lubricated, while avoiding an increase in number of parts. Moreover, the oil sump is defined in the upper surface of the rocker shaft holder and hence, can be formed easily.

According to an eleventh aspect and feature of the present invention, in addition to the tenth feature, the lubricating structure further includes a passage-defining member interposed between said hydraulic pressure control valve unit and said rocker shaft holder, and having communication passages interconnecting said hydraulic pressure control valve unit and said working oil passages, an upper portion of said passage-defining member being formed to be able to deliver the drain oil discharged from said hydraulic pressure control valve unit to said oil sump. With such arrangement, the drain oil discharged from the hydraulic pressure control valve unit is supplied from the passage-defining member to the oil sump in the rocker shaft holder and hence, a part exclusively for delivering the drain oil between the hydraulic pressure control valve unit and the oil sump is not required.

According to a twelfth aspect and feature of the present invention, in addition to the eleventh feature, the upper portion of the passage-defining member is provided with a recess adapted to receive the drain oil from said hydraulic pressure control valve unit, and a guide for guiding the drain oil accumulated in said recess toward said oil sump, said guide being extending from said passage-defining member to above said oil sump. With such arrangement, the drain oil can be reliably delivered from the passage-defining member to the oil sump in the rocker shaft holder. Thus, a sufficient amount of the drain oil can be supplied to the oil sump to perform the sufficient lubrication.

The above and other objects, features and advantages of the invention will become apparent from the following description of the preferred embodiment taken in conjunction with the accompanying drawings.

BRIEF DESCRIPTION OF THE DRAWINGS

FIGS. 1 to 12 show an embodiment of the present invention, wherein

FIG. 1 is a front view of a V-shaped multi-cylinder internal combustion engine to which the present invention is applied;

FIG. 2 is a plan view taken along a line 2—2 in FIG. 1 with a head cover removed;

FIG. 3 is a plan view similar to FIG. 2, but showing the internal combustion engine with a rocker shaft holder and a camshaft being partially cut away;

FIG. 4 is a sectional view taken along a line 4—4 in FIG. 2;

FIG. 5 is a sectional view taken along a line 5—5 in FIG. 2;

FIG. 6 is a sectional view taken along a line 6—6 in FIG. 2;

FIG. 7 is an enlarged sectional view taken along a line 7—7 in FIG. 6;

FIG. 8 is an enlarged sectional view taken along a line 8—8 in FIG. 4;

FIG. 9 is a sectional view taken along a line 9—9 in FIG. 8;

FIG. 10 is an enlarged sectional view taken along a line 10—10 in FIG. 2;

FIG. 11 is a view of a passage-defining member, taken in a direction of an arrow 11 in FIG. 10; and FIG. 12 is an enlarged sectional view taken along a line 12—12 in FIG. 2.

DESCRIPTION OF THE PREFERRED EMBODIMENT

Figure 1:
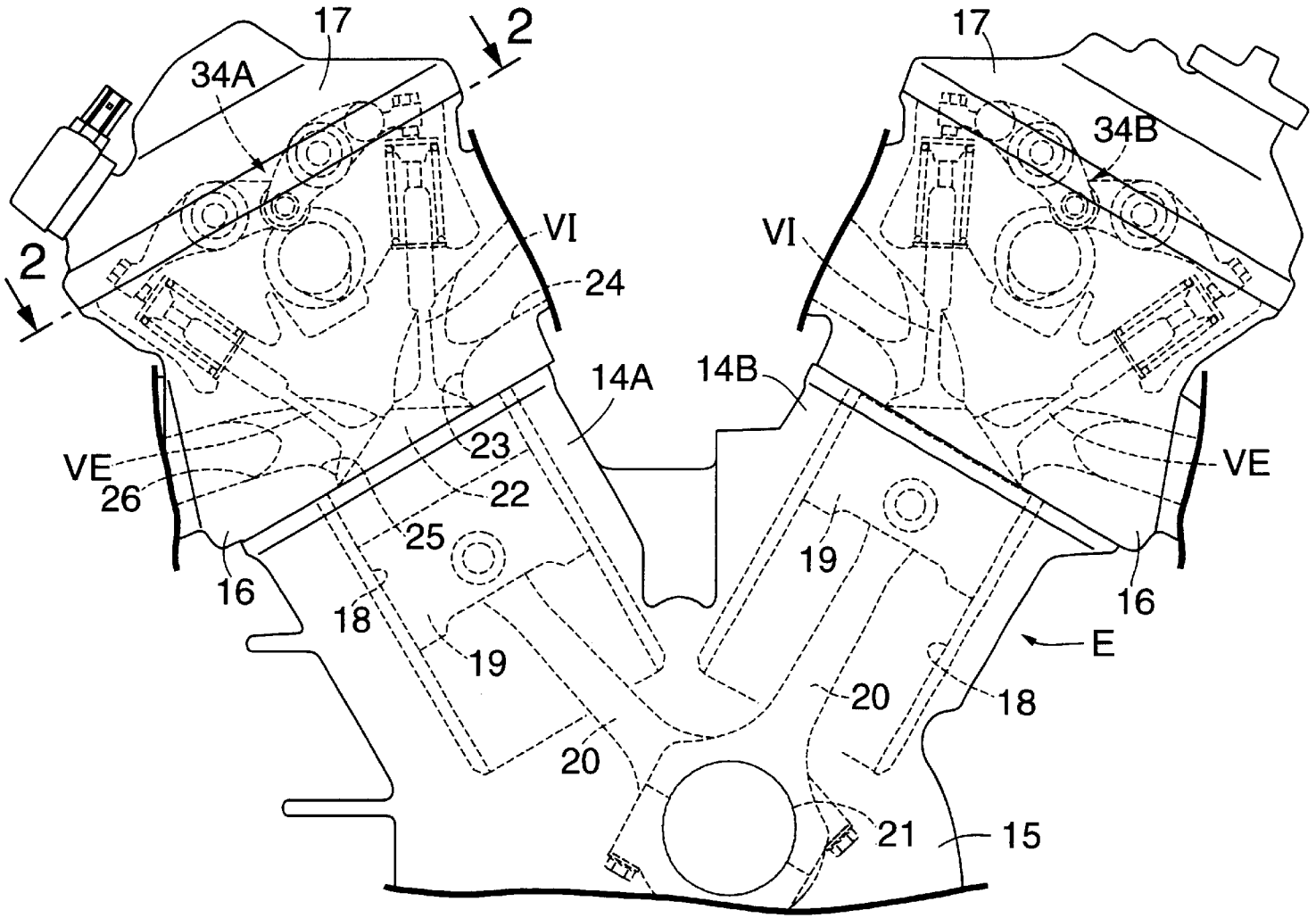
Figure 2:
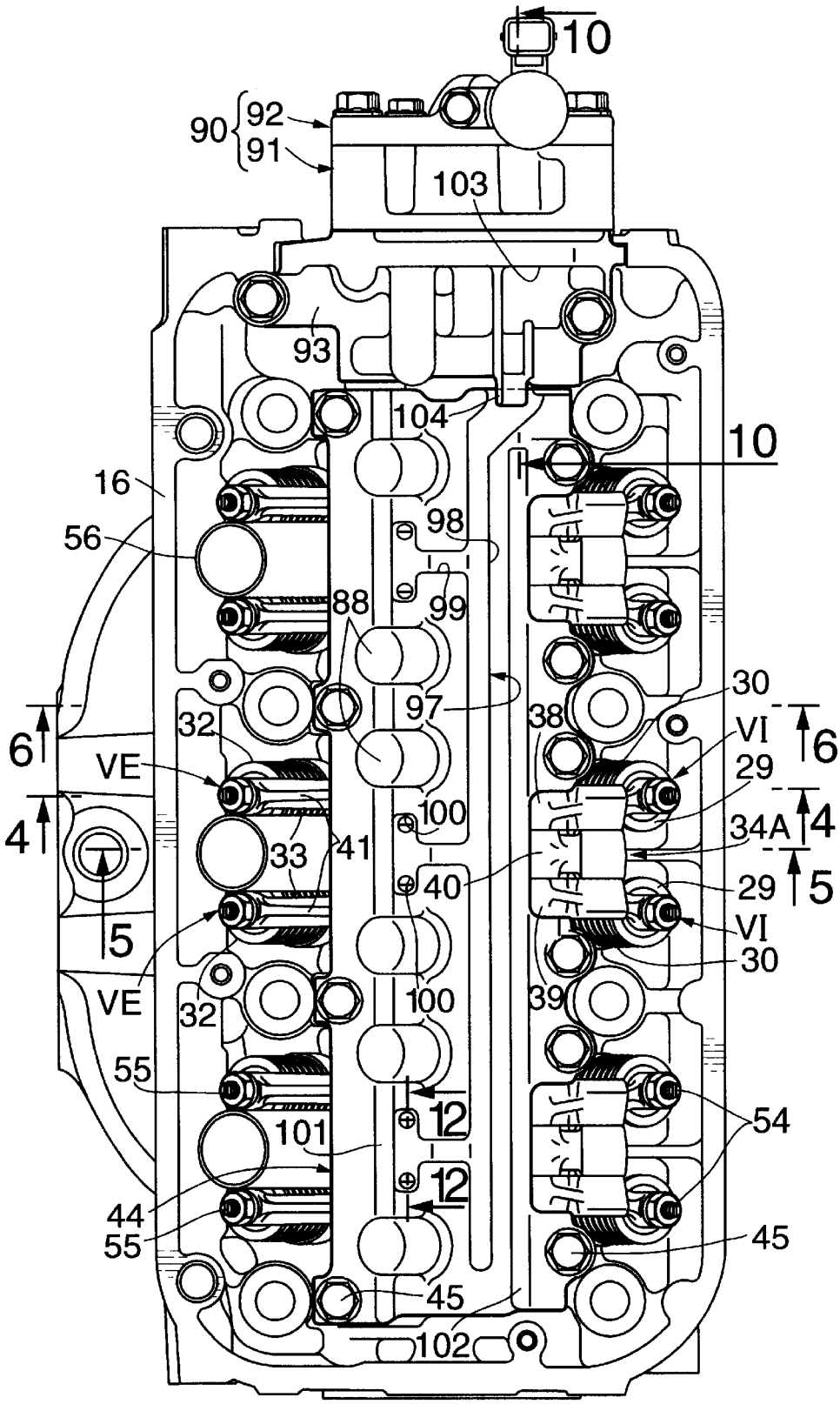
Figure 3:
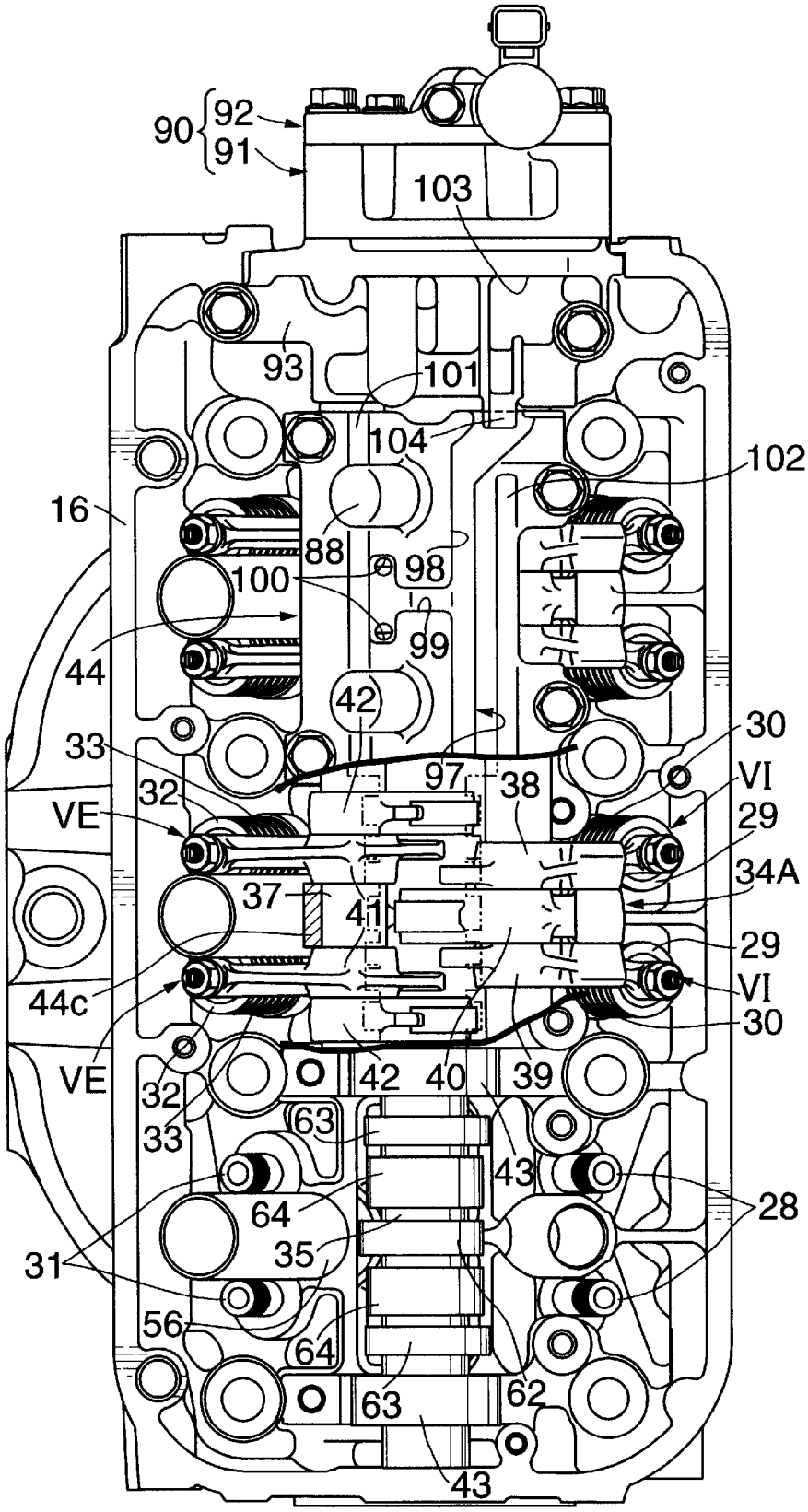
Figure 4:
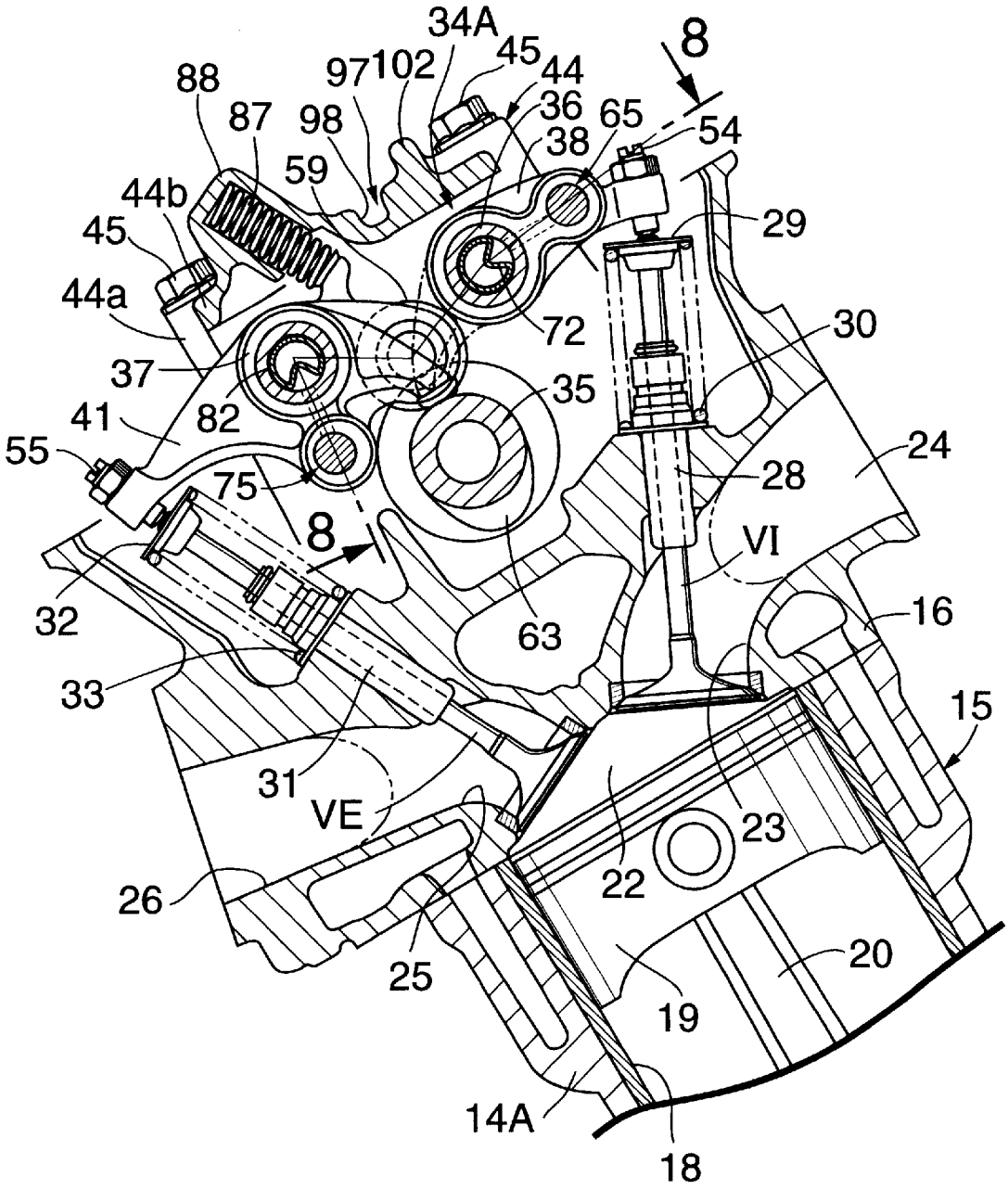
Figure 5:
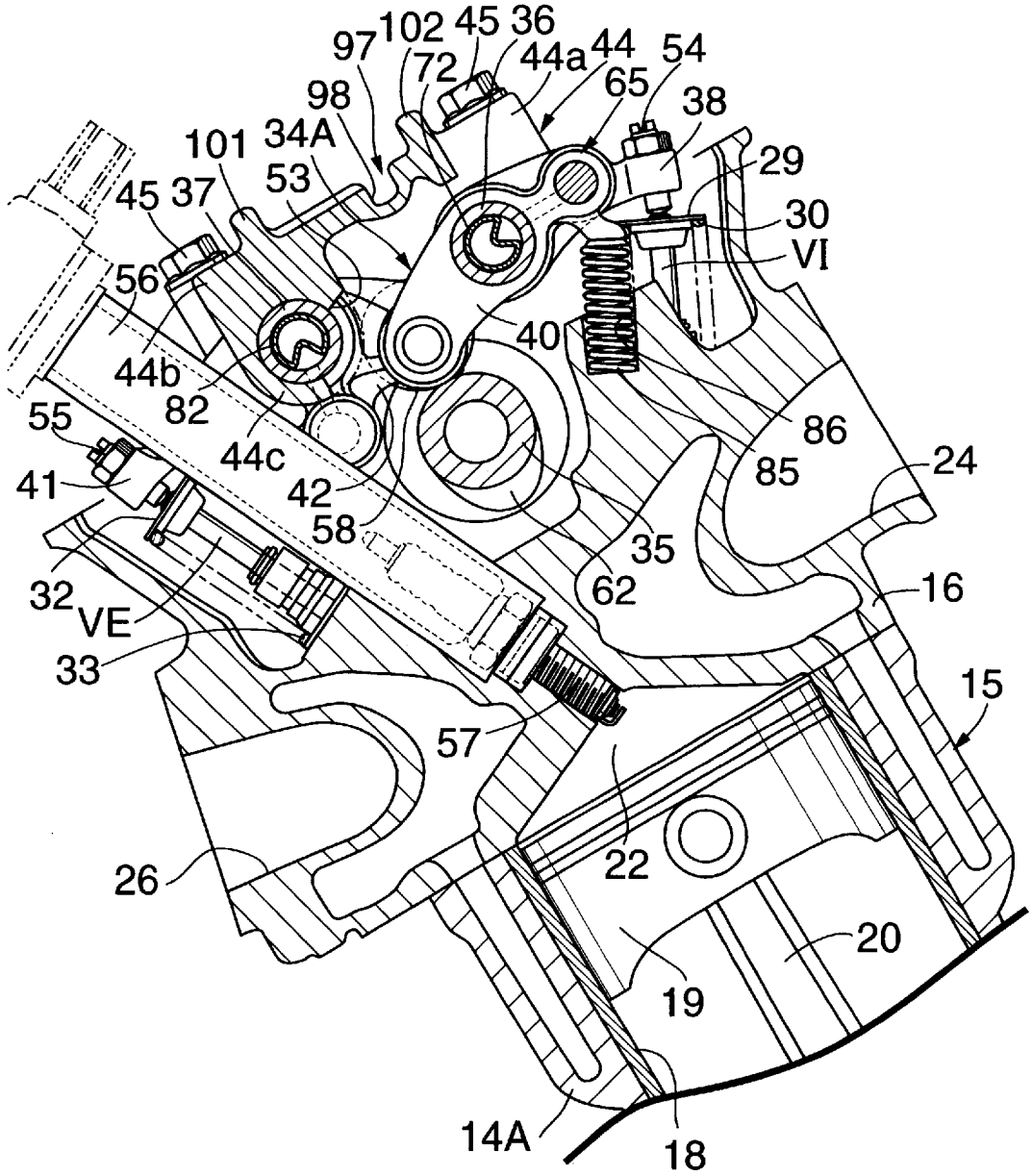
Figure 6:
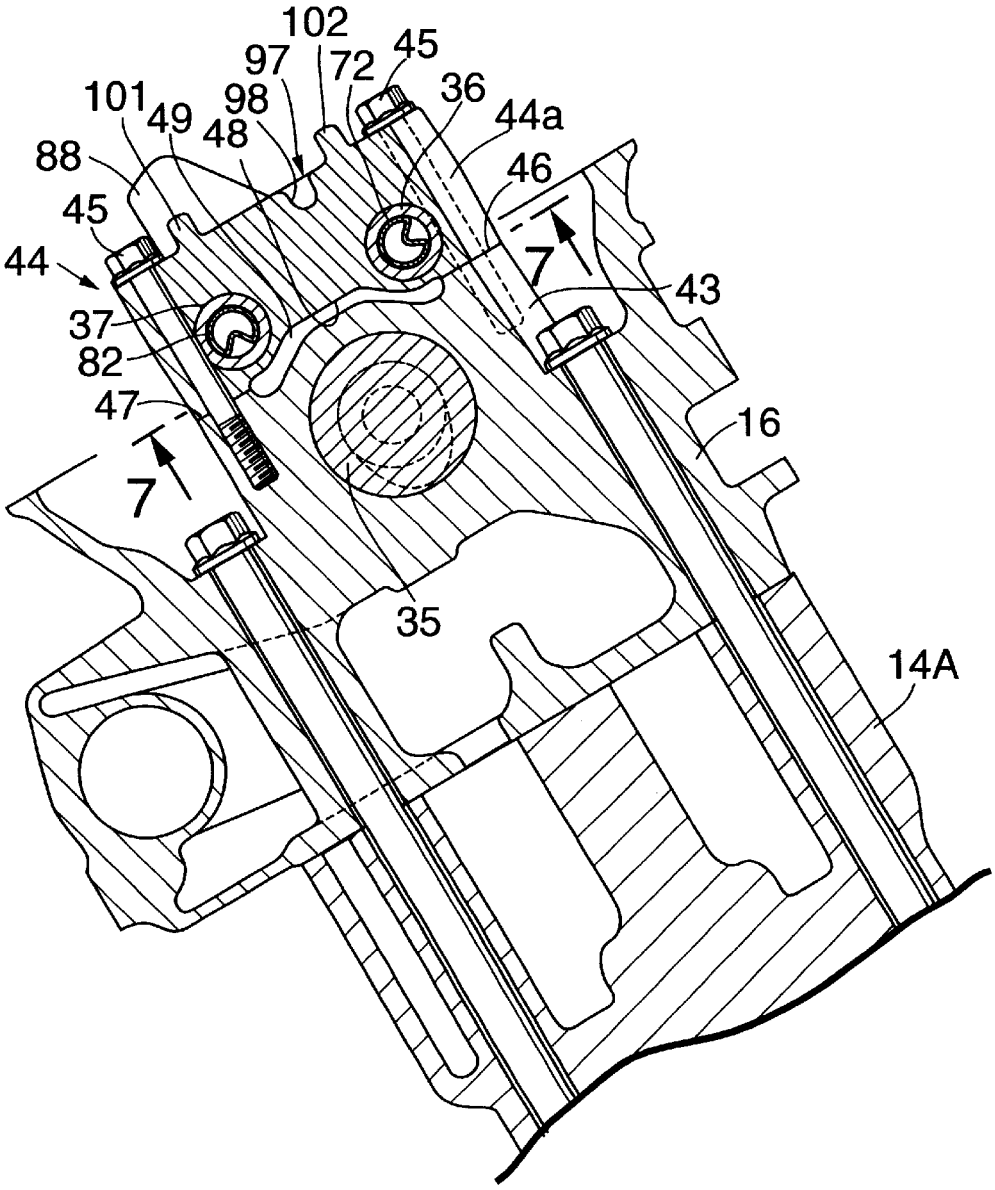

The present invention will now be described by way of an embodiment of the present invention with reference to FIGS. 1 to 12. Referring first to FIG. 1, a V-shaped multi-cylinder internal combustion engine E carried on a vehicle includes an engine block 15 having first and second cylinder arrays 14A and 14B disposed in a V-shape, cylinder heads 16, 16 coupled to upper ends of the first and second cylinder arrays 14A and 14B, and head covers 17, 17 coupled to the cylinder heads 16, 16. Three cylinder bores 18 are provided in a vertical arrangement as viewed on a paper sheet surface of FIG. 1 in each of the first and second cylinder arrays 14A and 14B, and pistons 19 slidably received in the cylinder bores 18 are commonly connected to a single crankshaft 21 by connecting rods 20, respectively.

The arrangement of the engine E on the side of the first cylinder array 14A will be described with reference to FIGS. 2 to 6. Combustion chambers 22 are defined between the cylinder head 16 and the pistons 19 in the cylinder bores 18. Provided in the cylinder head 16 at locations corresponding to the combustion chambers 22 are a pair of intake valve bores 23 capable of leading to the combustion chamber 22, an intake port 24 leading commonly to the intake valve bores 23 and opening into one side of the cylinder head 16, a pair of exhaust valve bores 25 capable of leading to the combustion chamber 22, and an exhaust port 26 leading commonly to the exhaust valve bores 25 and opening into the other side of the cylinder head 16. On the basis of the first and second cylinder arrays 14A and 14B forming the V-shape in combination with each other, the cylinder head 16 is disposed, inclined to one of the left and the right in a direction of arrangement of the cylinders, i.e., inclined so that the exhaust port 26 is at a location lower than the intake port 24.

Stems of intake valve VI, VI as engine valves capable of individually opening and closing the intake valve bores 23 are slidably received in guide tubes 28 provided in the cylinder head 16. Valve springs 30 for biasing the intake valves VI, VI in a closing direction are mounted between retainers 29 mounted at upper ends of the intake valves VI, VI and the cylinder head 16. Stems of exhaust valves VE, VE as engine valves capable of individually opening and closing the exhaust valve bores 25 are slidably received in guide tubes 31 provided in the cylinder head 16. Valve springs 33 for biasing the exhaust valves VE, VE in a closing direction are mounted between retainers 32 mounted at upper ends of the exhaust valves VE, VE and the cylinder head 16.

The intake valves VI, VI and the exhaust valves VE, VE for every cylinder are opened and closed by a valve operating device 34A. The valve operating device 34A includes a camshaft 35 having an axis extending in the direction of arrangement of the cylinders, a pair of rocker shafts 36 and 37 having axes parallel to the camshaft 35, driving rocker arms 38 and 39 and a free rocker arm 40, which are swingably carried on one of the rocker shaft 36 for every cylinder, and driving rocker arms 41, 41 and free rocker arms 42, 42, which are swingably carried on the other rocker shaft 37 for every cylinder.

A plurality of (four in the present embodiment) bearing sections 43 are integrally projectingly provided on the cylinder head 16 at distances in the direction of arrangement of the cylinders, so that the adjacent bearing sections sandwich each of the combustion chamber 22 therebetween, and the camshaft 35 is rotatably carried by the bearing sections 43. Moreover, the camshaft 35 is operatively connected to the crankshaft 21 at a reduction ratio of ½.

The pair of the rocker shafts 36 and 37 are fixedly disposed above the camshaft 35, and a rocker shaft holder 44 is fastened and fixed to upper surfaces of the bearing sections 43 to support the rocker shafts 36 and 37.

Figure 7:
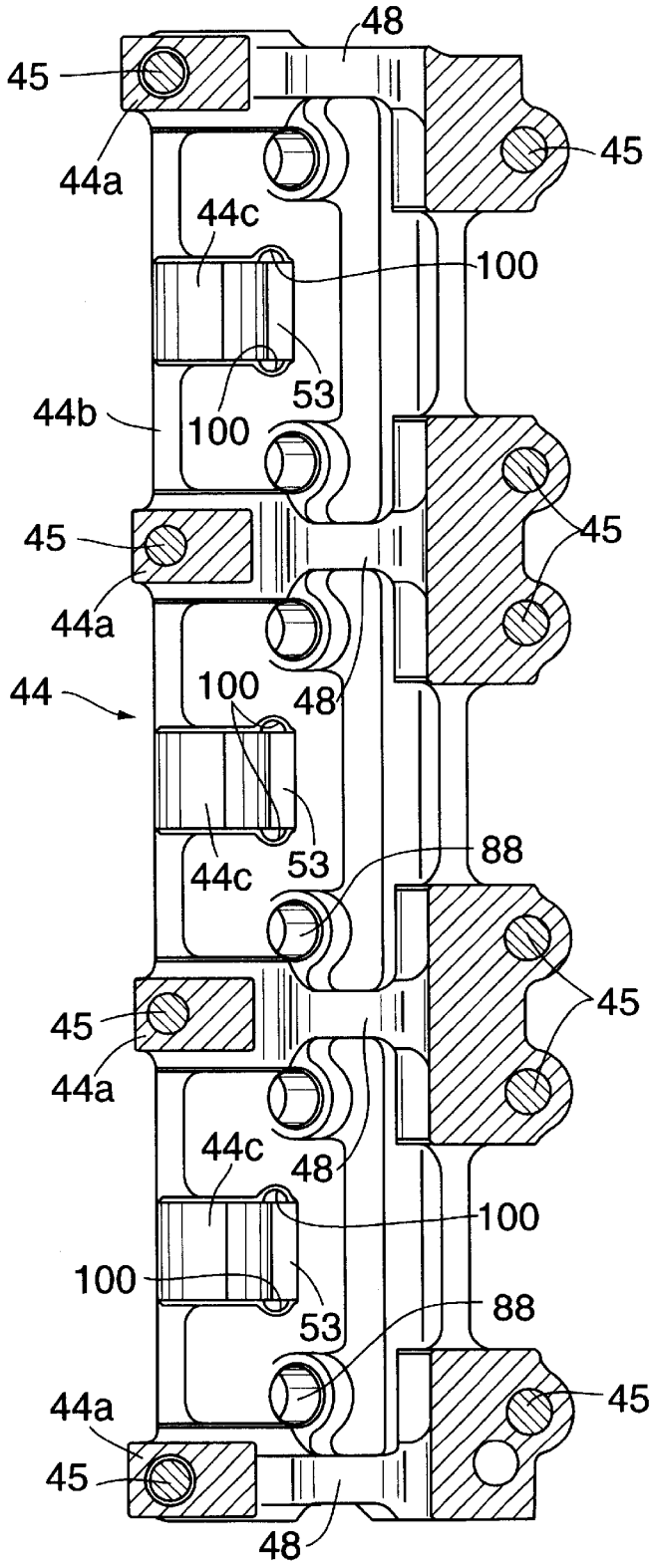

Referring also to FIG. 7, the rocker shaft holder 44 includes shaft-supporting sections 44*a* corresponding to the plurality of bearing sections 43, and a connecting section 44*b* for integrally connecting the shaft-supporting sections 44*a* together. The shaft-supporting sections 44*a* are fastened to the bearing sections 43 on opposite sides of the camshaft 35 by bolts 45, respectively.

The pair of rocker shafts 36 and 37 are supported on the shaft-supporting sections 44*a* at locations where the camshaft 35 is disposed below and between the rocker shafts 36 and 37. The rotation of the rocker shafts 36 and 37 about axes are inhibited by engagement of the bolts 45 for fastening the shaft-supporting sections 44*a* to the bearing sections 43 with a portion of an outer surface of each of the rocker shafts 36 and 37, whereby the rocker shafts 36 and 37 are fixedly supported on the rocker shaft holder 44.

A flat fastening seats 46 and 47 for fastening the rocker shaft holder 44 is formed on each of the bearing sections 43 on opposite sides of a portion which rotatably supports the camshaft 35, and the bearing sections 43 are formed to bulge above and between the fastening seats 46 and 47.

On the other hand, accommodating recesses 48 are provided in lower surfaces of the shaft-supporting sections 44*a* of the rocker shaft holder 44 at locations between the rocker shafts 36 and 37, so that a portion of a central bulge of the bearing section 43 protrudes into each of the accommodating recesses 48. The portion of the central bulge of the bearing section 43 is mounted to protrude into each of the accommodating recesses 48 in such a manner that the contact with the rocker shaft holder 44 is avoided, i.e., a gap 49 is defined between the accommodating recess 48 and the bearing section 43.

Moreover, the connecting section 44*b* of the rocker shaft holder 44 for connecting the shaft-supporting portions 44*a* together is formed to integrally connect at least portions of the shaft-supporting sections 44*a* corresponding to the accommodating recesses 48 to one another.

The rocker shafts 36 and 37 are supported by the shaft-supporting sections 44*a* of the rocker shaft holder 44, but the rocker shaft 37 on the side of the exhaust valves VE, VE is also supported by shaft-supporting intermediate portions 44*c* integrally provided on the connecting section 44*b* and disposed between the shaft-supporting sections 44*a*.

Figure 8:
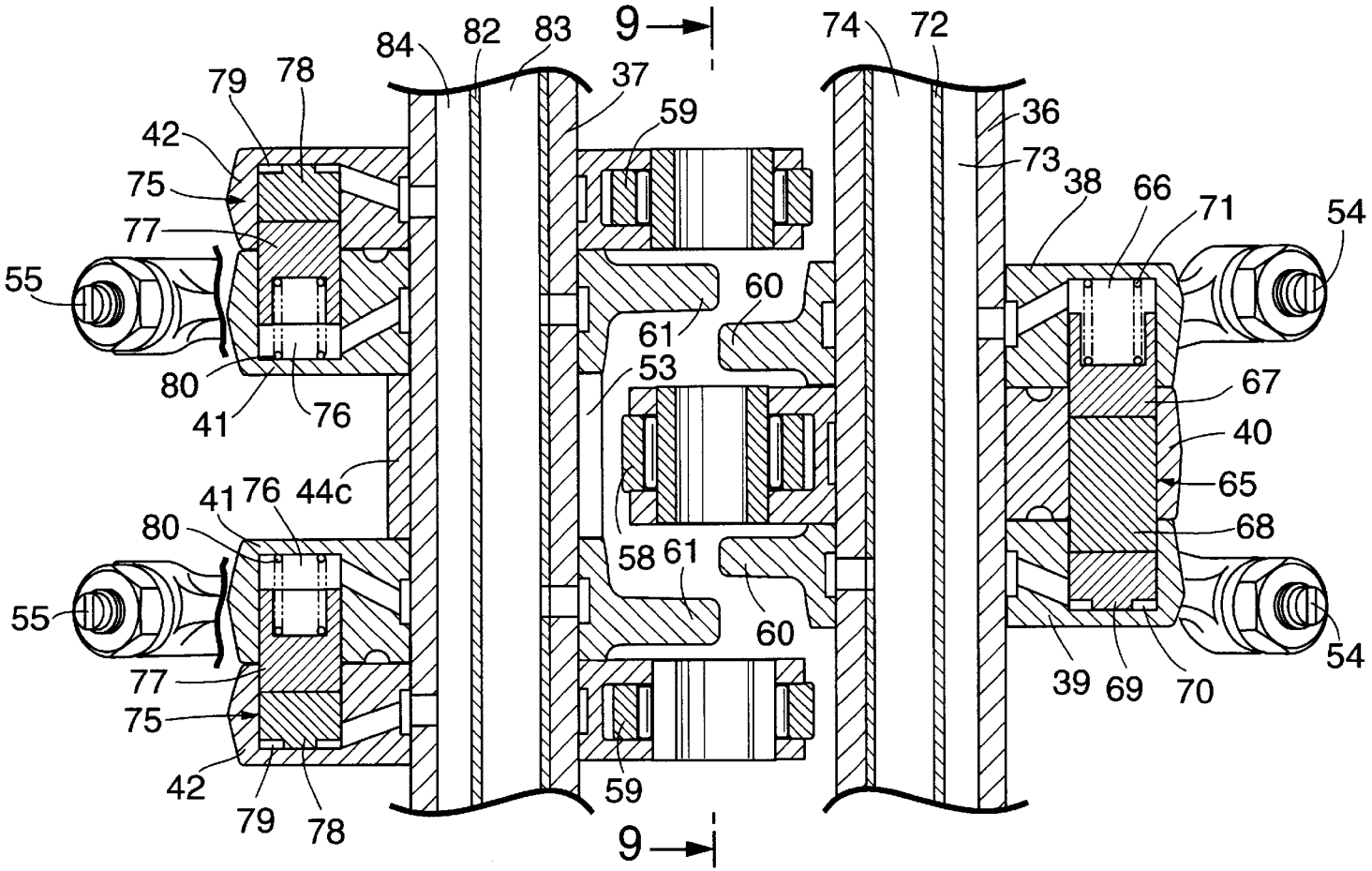

Referring to FIG. 8, the driving rocker arms 38 and 39 and the free rocker arm 40 swingably carried on the rocker shaft 36 are disposed in such a manner that the free rocker shaft 40 is interposed between the driving rocker arms 38 and 39. Tappet screws 54, 54 are threadedly engaged into the rocker arms 38 and 39, so that the advanced and retracted positions thereof can be adjusted, and the driving rocker arms 38 and 39 are operatively connected to the intake valves VI, VI by putting the tappet screws 54, 54 into abutment against upper ends of the intake valves VI, VI.

The driving rocker arms 41, 41 and the free rocker arms 42, 42 swingably carried on the rocker shaft 37 are disposed in such a manner that they form pairs at locations spaced apart from each other in an axial direction of the rocker shaft 37. Tappet screws 55, 55 are threadedly engaged into the rocker arms 41, 41, so that the advanced and retracted positions thereof can be adjusted, and the rocker arms 41, 41 are operatively connected to the exhaust valves VE, VE by putting the tappet screws 55, 55 into abutment against upper ends of the exhaust valves VE, VE.

Moreover, the shaft-supporting intermediate portion 44*c* of the rocker shaft holder 44 is disposed between the driving rocker arms 41, 41, and the driving rocker arms 41, 41 are disposed adjacent opposite sides of the shaft-supporting intermediate portion 44*c* in the axial direction of the rocker shaft 37.

Plug insertion tubes 56 are mounted in the cylinder head 16, so that they are disposed between the driving rocker arms 41, 41. Spark plugs 57 are inserted into the plug insertion tubes 56 and threadedly fitted in the cylinder head 16 to face the combustion chambers 22.

Figure 9:
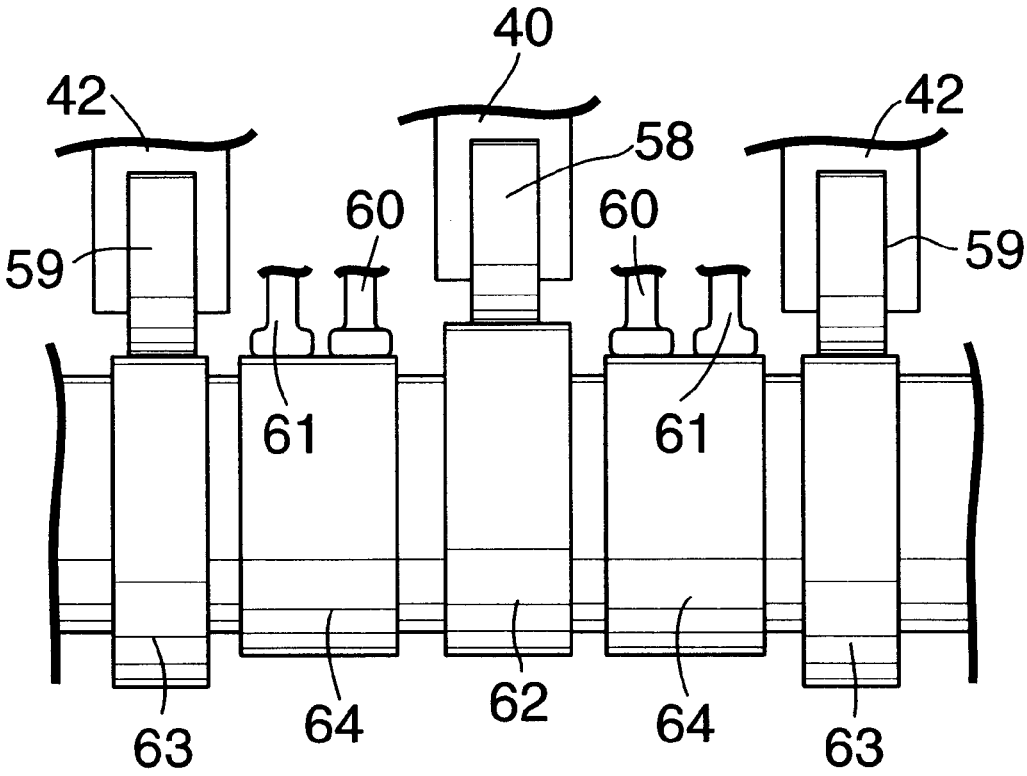

Referring also to FIG. 9, the camshaft 35 is provided with a cam 62 with which a roller 58 supported on the free rocker arm 40 on the side of the intake valves VI, VI is brought into rolling contact, cams 63, 63 with which rollers 59, 59 supported on the free rocker arms 42, 42 on the side of the exhaust valves VE, VE are brought into rolling contact, and a pair of cams 64, 64 with which cam slippers 60, 60 provided on the driving rocker arms 38 and 39 on the intake valves VI, VI and cam slippers 61, 61 provided on the driving rocker arms 41, 41 on the exhaust valves VE, VE are brought into sliding contact. The cams 62, 63, 63, 64, 64 are disposed, so that the cams 64, 64 are interposed between the cam 62 central in the axial direction of the camshaft 35 and the cams 63, 63 on opposite sides in the axial direction of the camshaft 35.

Moreover, the cams 62 are provided at locations corresponding to the shaft-supporting intermediate portions 44*c* of the rocker shaft holder 44, and the rollers 58 in rolling contact with the cams 62 are supported on the free rocker arms 40 on the intake valves VI, VI, so that they are opposed to the shaft-supporting intermediate portions 44*c*. On the other hand, the shaft-supporting intermediate portions 44*c* are provided with notches 53 for avoiding the interference with the rollers 58, whereby each of the shaft-supporting intermediate portions 44*c* is formed into a substantially J-shape.

The cam 62 is formed to have a cam profile for opening and closing the intake valves VI, VI, and each of the cams 63, 63 is formed to have a cam profile for opening and closing the exhaust valves VE, VE, but the cams 64, 64 are formed, so that they substantially close the intake valves VI, VI and the exhaust valves VE, VE to bring them out of operation. Therefore, in a state in which the driving rocker arms 38 and 39 have been connected to the free rocker arm 40, the intake valves VI, VI can be opened and closed, but in a state in which the connection of the driving rocker arms 38 and 39 to the free rocker arm 40 has been released, the intake valves VI, VI are in substantially closed states and out of operation. In a state in which the driving rocker arms 41, 41 have been connected to the free rocker arms 42, 42, the exhaust valves VE, VE can be opened and closed, but in a state in which the connection of the driving rocker arms 41, 41 to the free rocker arms 42, 42 has been released, the exhaust valves VE, VE are in substantially closed states and out of operation.

A valve-operating characteristic changing mechanism 65 is provided in the driving rocker arms 38 and 39 and the free rocker arm 40 on the side of the intake valves VI, VI for changing the connection and disconnection of the driving rocker arms 38 and 39 to and from the free rocker arm 40.

The valve-operating characteristic changing mechanism 65 includes a connecting pin 67 slidably received in the driving rocker arm 38 and the free rocker arm 40 with one end facing a first hydraulic pressure chamber 66 defined in the driving rocker arm 38, a connecting pin 68 slidably received in the free rocker arm 40 and the driving rocker arm 39 with one end being in sliding contact with the other end of the connecting pin 67, a pin 69 with one end being in sliding contact with the other end of the connecting pin 68 and with the other end facing a second hydraulic pressure chamber 70 defined in the driving rocker arm 39, and a return spring 71 mounted between the driving rocker arm 38 and the connecting pin 67 and accommodated in the first hydraulic pressure chamber 66.

In the valve-operating characteristic changing mechanism 65, when a hydraulic pressure is applied to the first hydraulic pressure chamber 66, the connecting pins 67 and 68 and the pin 69 connected together are moved to a position where the volume of the second hydraulic pressure chamber 70 is smallest, whereby the driving rocker arm 38 and the free rocker arm 40 are connected to each other by the connecting pin 67, and the free rocker arm 40 and the driving rocker arm 39 are connected to each other by the connecting pin 68, as shown in FIG. 8. When a hydraulic pressure is applied to the second hydraulic pressure chamber 70, the connecting pins 67 and 68 and the pin 69 connected together are moved to a position where the volume of the first hydraulic pressure chamber 66 is smallest, whereby the connection of the driving rocker arm 38 and the free rocker arm 40 is released, because contact faces of the connecting pins 67 and 68 exist between the driving rocker arm 38 and the free rocker arm 40, and the connection of the free rocker arm 40 and the driving rocker arm 39 is released, because contact faces of the connecting pin 68 and the pin 69 exist between the free rocker arm 40 and the driving rocker arm 39.

In this manner, the valve-operating characteristic changing mechanism 65 changes the operating characteristic for the intake valves VI, VI by switching the connection and disconnection of the free rocker arm 40 to and from the driving rocker arms 38 and 39 by the alternative application of the hydraulic pressure to the first and second hydraulic pressure chambers 66 and 70. The return spring 71 may merely exhibit a spring force enough to be able to avoid the chattering of each of the pins 67, 68 and 69 in a state in which no hydraulic pressure is applied to any of the first and second hydraulic pressure chambers 66 and 70 in response to the stoppage of the operation of the engine E.

A dividing member 72 is received in the rocker shaft 36 for dividing the inside of the rocker shaft 36 into two portions, so that a first working oil passage 73 leading to the first hydraulic pressure chamber 66 and a second working oil passage 74 leading to the second hydraulic pressure chamber 70 are defined independently in the rocker shaft 36 by the dividing member 72.

Valve-operating characteristic changing mechanisms 75, 75 are provided in the driving rocker arms 41, 41 and the free rocker arms 42, 42 disposed adjacently to form pairs on the side of the exhaust valves VE, VE for changing the connection and disconnection of the driving rocker arms 41, 41 to and from the free rocker arms 42, 42.

Each of the valve-operating characteristic changing mechanism 75 includes a connecting pin 77 slidably received in the driving rocker arm 41 and the free rocker arm 42 with one end facing a first hydraulic pressure chamber 76 defined in the driving rocker arm 41, a pin 78 slidably received in the free rocker arm 42 with one end being in sliding contact with the other end of the connecting pin 77 and with other end facing a hydraulic pressure chamber 79 defined in the free rocker arm 42, and a return spring 80 mounted between the driving rocker arm 41 and the connecting pin 77 and accommodated in the first hydraulic pressure chamber 76.

In the valve-operating characteristic changing mechanism 75, when a hydraulic pressure is applied to the first hydraulic pressure chamber 76, the connecting pin 77 and the pin 78 connected to each other are moved to a position where the volume of the second hydraulic pressure chamber 79 is smallest, whereby the driving rocker arm 41 and the free rocker arm 42, as shown in FIG. 8. When a hydraulic pressure is applied to the second hydraulic pressure chamber 79, the connecting pin 77 and the pin 78 connected to each other are moved to a position where the volume of the first hydraulic pressure chamber 76 is smallest, whereby the connection of the free rocker arm 42 and the driving rocker arm 41 is released, because contact faces of the connecting pin 77 and the pin 78 exist between the free rocker arm 42 and the driving rocker arm 41.

In this manner, the valve-operating characteristic changing mechanism 75 changes the operating characteristic for the exhaust valves VE, VE by switching the connection and disconnection of the driving rocker arm 41 and the free rocker arm to and from each other by the alternative application of the hydraulic pressure to the first and second hydraulic pressure chambers 76 and 79. The return spring 80 may merely exhibit a spring force enough to be able to avoid the chattering of each of the pins 77 and 78 in a state in which no hydraulic pressure is applied to any of the first and second hydraulic pressure chambers 76 and 79 in response to the stoppage of the operation of the engine E.

A dividing member 82 is received in the rocker shaft 37 for dividing the inside of the rocker shaft 37 into two portions, so that a first working oil passage 83 leading to the first hydraulic pressure chamber 76 and a second working oil passage 84 leading to the second hydraulic pressure chamber 79 are defined independently in the rocker shaft 37 by the dividing member 82.

Lost motion springs 85 are mounted between the cylinder head 16 and the free rocker arms 40 for exhibiting a spring force for urging the free rocker arm 40 to the cam 62 of the camshaft 35 in a state in which the valve-operating characteristic changing mechanism 65 on the side of the intake valves VI, VI has released the connection of the free rocker arm 40 to the driving rocker arms 38 and 39. A portion of each of the spring 85 is accommodated in each of bottomed holes 86 provided in the upper surface of the cylinder head 16.

Lost motion springs 87 are mounted between the rocker shaft holder 44 and the free rocker arms 42 for exhibiting a spring force for urging the free rocker arms 42, 42 to the cams 63, 63 of the camshaft 35 in a state in which the valve-operating characteristic changing mechanisms 75, 75 on the side of the exhaust valves VE, VE have released the connection of the free rocker arms 42, 42 to the driving rocker arms 41, 41. Bottomed cylindrical tubes 88 are integrally provided on the connecting section 44*b* of the rocker shaft holder 44 to protrude upwards from the rocker shaft holder 44, so that a portion of each of the springs 87 is accommodated in each of the bottomed cylindrical tubes 88.

The lost motion springs 87 each having the portion accommodated in each of the bottomed cylindrical tubes 88 cannot be fallen from the rocker shaft holder 44 in a state in which the rocker shaft 37 swingably carrying the driving rocker arms 41 and the free rocker arms 42 has been supported in the rocker shaft holder 44. Thus, the lost motion springs 87 can be retained on the rocker shaft holder 44 in an extremely simple structure in which they are only partially accommodated in the bottomed cylindrical tubes 88.

Moreover, the bottomed cylindrical tubes 88 are integrally provided on the rocker shaft holder 44 to protrude therefrom, so that they are connected to the shaft-supporting sections 44*a*, and the rigidity of the shaft-supporting sections 44*a* and in turn the rigidity of the entire rocker shaft holder 44 can be increased by the bottomed cylindrical tubes 88.

Figure 10:
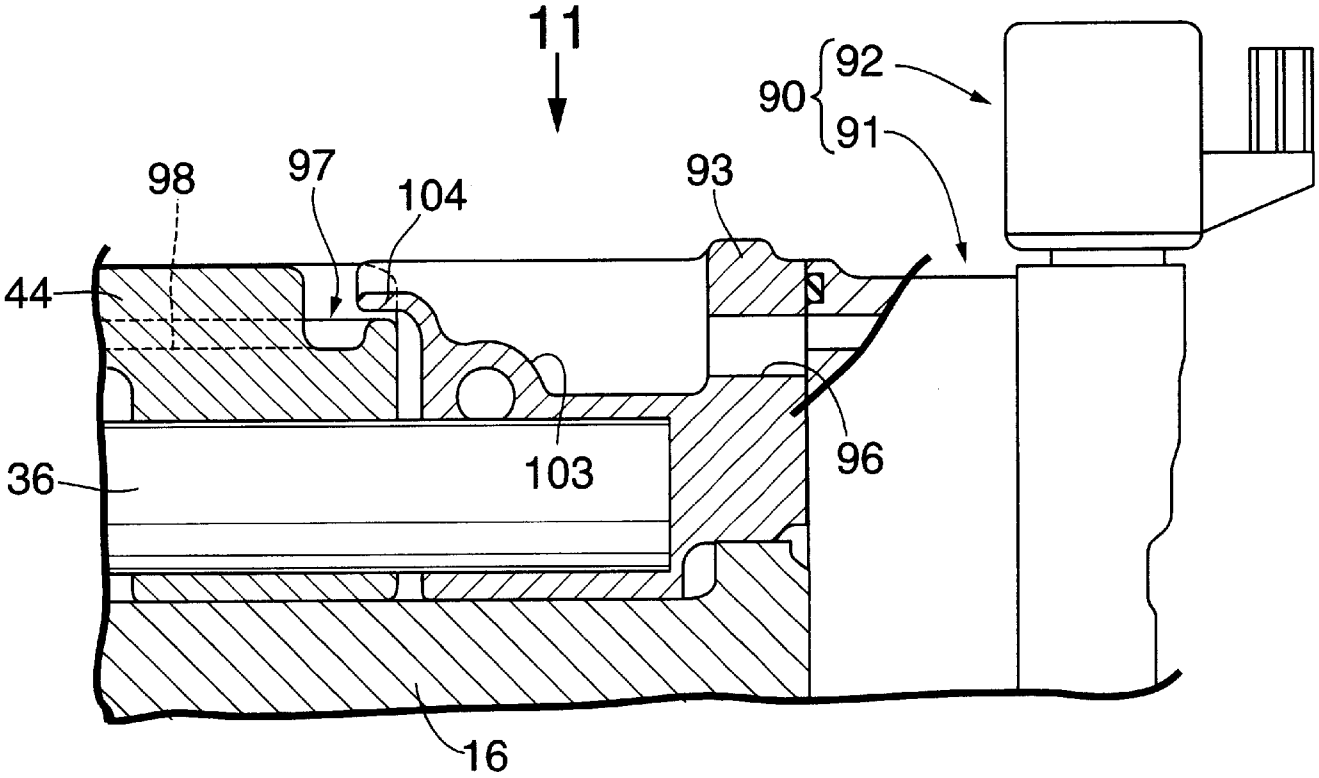

Referring also to FIG. 10, a hydraulic pressure control valve unit 90 is mounted to the cylinder head 16 at one end in the direction of arrangement of the cylinders for controlling the hydraulic pressure of the working oil supplied to the first working oil passages 73 and 83 and the second working oil passages 74 and 84 defined in the rocker shafts 36 and 37.

The hydraulic pressure control valve unit 90 comprises a valve spool 91 mounted to the cylinder had 16, and a solenoid valve 92 mounted to the spool valve 91 for controlling the switching operation of the spool valve 91. A passage-defining member 93 is mounted on the cylinder head 16 between the spool valve 91 and the rocker shaft holder 44, and one end of each of the rocker shafts 36 and 37 is fitted into the passage-defining member 93.

Figure 11:
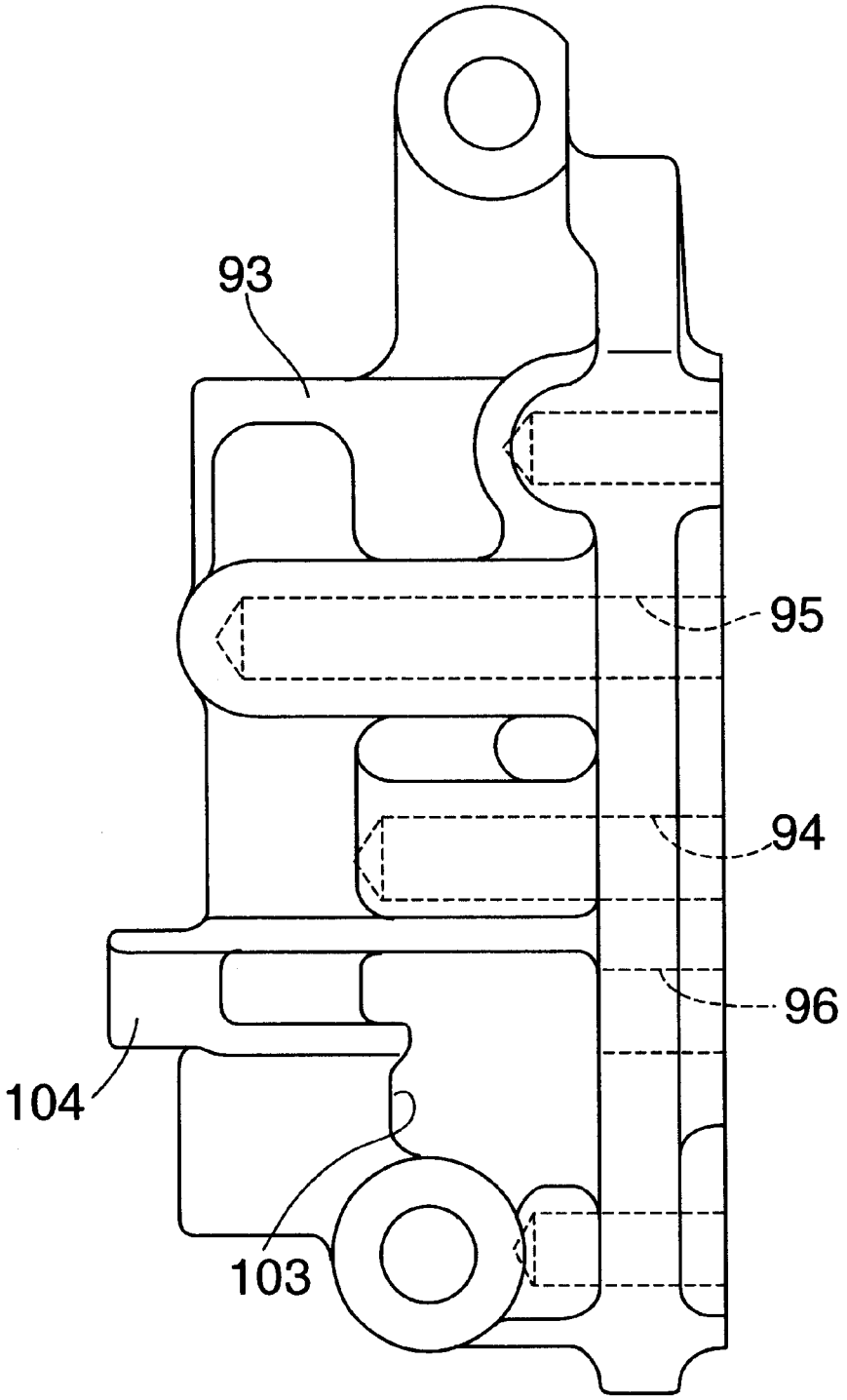

Referring also to FIG. 11, the passage-defining member 93 is provided with a first communication oil passage 94 connecting the first working oil passages 73 and 83 in the rocker shafts 36 and 37 and the spool valve 91 to each other, and a second communication oil passage 95 connecting the second working oil passages 74 and 84 in the rocker shafts 36 and 37 and the spool valve 91 to each other. The spool valve 91 is capable of being switched between a first state in which it permits the working oil from a hydraulic pressure source (not shown) to be passed to the first communication oil passage 94 and thus to the first working oil passages 73 and 83, and a second state in which it permits the working oil from the hydraulic pressure source to be passed to the second communication oil passage 95 and thus to the second working oil passages 74 and 84.

Moreover, the spool valve 91 is designed to discharge a drain oil upon the switching thereof between the first and second states, and a drain oil passage 96 for guiding the drain oil is provided in an upper portion of the passage-defining member 93.

On the other hand, an oil sump 97 is defined in the upper surface of the rocker shaft holder 44, so that the oil scattered within the valve-operating chamber between the cylinder head 16 and the head cover 17 can be reserved in the oil sump.

The oil sump 97 includes a groove portion 98 extending in the direction of arrangement of the cylinders and substantially T-shaped groove branches 99 which are disposed between the pair of bottomed cylindrical tubes 88, 88 at locations corresponding to the centers of the combustion chambers 22 and which are connected to the groove portion 98. The groove branches 99 are formed, so that they are connected to the side of the groove portion 98 adjacent the exhaust valves VE, VE in order to guide the oil in the groove portion 98 toward the groove branches 99, on the basis of the cylinder 16 being disposed, inclined so that the exhaust port 26 is located below the intake port 23.

Figure 12:
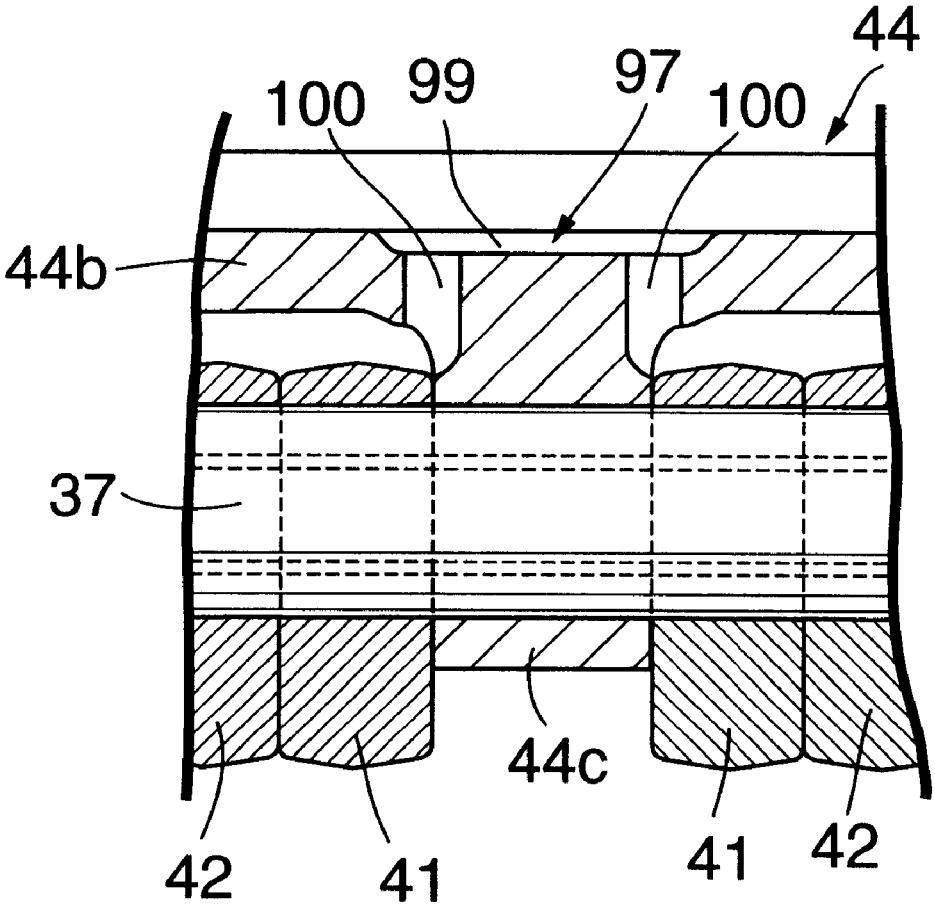

Referring also to FIG. 12, a rib 101 is projectingly provided on the upper surface of the rocker shaft holder 44 to extend in the direction of arrangement of the cylinders. The rib 101 has a side face located below the groove portion 98 and connected flush to peripheral walls of ends of the groove branches 99. The rib 101 connects those portions of the bottomed cylindrical tubes 88, 88 disposed on opposite sides of the groove branches 99, which are located at lower sides in a direction of inclination of the cylinder head 16. The bottomed cylindrical tubes 88, 88 and the rib 101 are disposed in a substantially U-shape to constitute a portion of the oil sump 98, and the rib 101 is a wall defining a lowermost portion of the oil sump 97.

Lubricating oil passages 100 are provided in the rocker shaft holder 44 to vertically extend through the connecting section 44*b* along the side face of the rib 101 adjacent the oil sump 97. Upper ends of the lubricating oil passages 100 communicate in pairs with ends of the groove branches 99 which are portions of the oil sump 97 closer to the ribs 101, i.e., with the oil sump 97 in a region surrounded by the bottomed cylindrical tubes 88, 88 and the rib 101.

The lubricating oil passages 100 forming each pair are disposed at locations where the shaft-supporting intermediate portion of the rocker shaft holder 44 is interposed between them. A lubricating oil is supplied from the lubricating oil passages 100, 100 for lubricating slide portions between the shaft-supporting intermediate portion 44*c* and those 41, 41 of the rocker arms 38 to 40, 41 and 42 adjoining the shaft-supporting intermediate portion 44*c*, slide portions between the driving rocker arms 41, 41 and the rocker shaft 37 and slide portions between the free rocker arms 42, 42 adjoining the driving rocker arms 41, 41 and the rocker shaft 37.

A rib 102 is projectingly provided on the upper surface of the rocker shaft holder 44 to extend in the direction of arrangement of the cylinders, so that the oil sump 97 is interposed between the rib 101 and the rib 102. Moreover, the ribs 101 and 102 are provided over the longitudinal entire length of the rocker shaft holder 44, and the shaft-supporting sections 44*a* and the shaft-supporting intermediate portions 44*c* of the rocker shaft holder 44 are interconnected by the ribs 101 and 102.

The drain oil discharged from the hydraulic pressure control valve unit 90 is also guided to the oil sump 97, and an upper portion of the passage-defining member 93 interposed between the hydraulic pressure control valve unit 90 and the rocker shaft holder 44 is formed to permit the drain oil discharged from the hydraulic pressure control valve unit 90 to be delivered to the oil sump 97.

More specifically, the upper portion of the passage-defining member 93 is provided with a recess 103 with which the drain oil passage 96 for guiding the drain oil from the hydraulic pressure control valve unit 90 communicate, and a substantially U-shaped guide 104 which opens upwards to guide the drain oil accumulated in the recess 103 toward the oil sump 97. The guide 104 is extended from the passage-defining member 93 to above one end of the groove portion 98 of the oil sump 97.

The arrangement of the second cylinder array 14B is basically the same as the arrangement of the first cylinder array 14A, but a valve-operating device 34B for driving the intake valves VI and the exhaust valves VE provided in the cylinder head 16 on the second cylinder array 14B is different from the valve-operating device 34A on the first cylinder array 14A in that the valve-operating device 34B does not close the intake valves VI and the exhaust valves VE to stop their operation during operation of the engine E.

The operation of this embodiment will be described below. The bearing sections 43 rotatably carrying the camshaft 35 are projectingly provided on the cylinder head 16 at distances spaced apart from one another in the direction of arrangement of cylinders in such a manner that each of the combustion chambers 22 is defined between the adjacent bearing sections 43. On the other hand, the rocker shafts 36 and 37 disposed above the camshaft 35 to swingably carry the rocker arms 38, 39, 40, 41 and 42 rotated with the rotation of the camshaft 35 are fixedly supported by the rocker shaft holder 44 fastened to the bearing sections 43 and thus, the support rigidity of the rocker shaft 36 and 37 can be enhanced.

The rocker shaft holder 44 includes the shaft-supporting sections 44*a* fastened to the bearing sections 43, and the connecting section 44*b* connecting the shaft-supporting sections 44*a* together, and the accommodating recesses 48 are provided in the lower surfaces of the shaft-supporting sections 44*a*, so that the bearing sections 43 partially protrude into the accommodating recesses 48. Thus, the structure of fastening of the bearing sections 43 and the rocker shaft holder 44 to each other can be constructed compactly in the direction along the axes of the cylinder bores 18 to avoid an increase in size of the engine E. Moreover, the connecting section 44*b* integrally connects at least portions of the shaft-supporting sections 44*a* corresponding to the accommodating recesses 48 to one another and hence, a reduction in rigidity of the rocker shaft holder 44 can be avoided in spite of the provision of the accommodating recesses 48 in the shaft-supporting sections 44*a*.

The bearing sections 43 partially protrude into the accommodating recesses 48 to avoid the contact with the rocker shaft holder 44 and hence, it is possible to inhibit the vibration of the camshaft 35 to the utmost from being transmitted through the rocker shaft holder 44 to the rocker shafts 36 and 37.

In addition, the pair of rocker shafts 36 and 37 parallel to each other are supported on the rocker shaft holder 44, and the accommodating recesses 48 are provided in the rocker shaft holder 44 between the rocker shafts 36 and 37. Thus, the structure of fastening between the bearing sections 43 and the rocker shaft holder 44 to each other can be constructed further compactly in the direction along the axes of the cylinder bores 18 in such a manner that the distances between the rocker shafts 36 and 37 and the camshaft 35 can be shortened.

The connecting section 44*b* of the rocker shaft holder 44 is integrally provided with the shaft-supporting intermediate portions 44*c* disposed between the shaft-supporting sections 44*a*, and one 37 of the rocker shafts 36 and 37 is supported not only by the shaft-supporting sections 44*a* but also by the shaft-supporting intermediate portions 44*c*. Thus, the support rigidity of the rocker shaft 37 can be enhanced sufficiently.

Additionally, the shaft-supporting intermediate portions 44*c* are provided with the notches 53 adapted to avoid the interference with the rollers 58 supported on the free rocker arm 40 on the side of the intake valves VI, VI and opposed to the shaft-supporting intermediate portions 44*c*, and the free rocker arm 40 provided with the roller 58 can be disposed in sufficient proximity to the rocker shaft 37 in spite of the existence of the shaft-supporting intermediate portions 44*c*, whereby the valve-operating devices 34A and 34B including the free rocker arm 40 and the rocker shaft 37 can be constructed compactly.

Moreover, the driving rocker arms 41, 41 on the exhaust valves VE, VE are disposed adjacent the shaft-supporting intermediate portions 44*c* in the axial direction of the rocker shaft 37. Therefore, it is possible to inhibit the axial movement of the driving rocker arm 41 by the shaft-supporting intermediate portions 44*c* and hence, a part exclusively for limiting the axial movement of the driving rocker arm 41 is nor required, leading to a reduction in number of parts.

The oil sump 97 is defined in the upper surface of the rocker shaft holder 44, and the lubricating oil passages 100 are provided in the rocker shaft holder 44, so that the lubricating oil can be supplied to the slide portions of the driving rocker arm 41 and the free rocker arm 42 which are two of the rocker arms 38 to 40, 41 and 42 relative to the rocker shaft 37 and the slide portions between the shaft-supporting intermediate portions 44*c* and the driving rocker arm 41. Therefore, the oil accumulated in the oil sump 97 can be reliably supplied from the oil sump through the lubricating oil passages 100 to the slide portions of the driving rocker arm 41 and the free rocker arm 42 relative to the rocker shaft 37 and the slide portions between the shaft-supporting intermediate portions 44*c* and the driving rocker arm 41 to positively lubricate such slide portions. Thus, a part exclusively for lubricating the slide portions between the driving rocker arm 41 and the free rocker arm 42 and the slide portions between the shaft-supporting intermediate portions 44*c* and the driving rocker arm 41 is not required, and the slide portions can be lubricated, while avoiding an increase in number of parts. Moreover, the oil sump 97 is defined in the upper surface of the rocker shaft holder 44 and hence, can be formed easily.

The oil sump 97 is formed in the upper surface of the rocker shaft holder 44 and provided with the groove portion 98 extending the direction of arrangement of the cylinders, and the groove branches 99 connected to the groove portion 98. The rib 101 is projectingly provided in the rocker shaft holder 44 to extend in the direction of arrangement of the cylinders, and has the side face connected flush to a portion of the peripheral wall of the oil sump 97, i.e., the peripheral walls of the ends of the groove branches 99. In addition, the lubricating oil passages 100 are provided in the rocker shaft holder 44 in such manner that their upper ends communicate with a portion of the oil sump 97 closer to the rib 101 (the ends of the groove branches 99 in the present embodiment) and they extend through the rocker shaft holder 44 along the side face of the rib 101 adjacent the oil sump 97. Therefore, it is possible to compensate for a reduction in rigidity of the rocker shaft holder 44 due to the provision of the lubricating oil passages 100, while enabling the supplying of the oil in the oil sump 97 to each of the cylinders.

The cylinder head 16 is disposed in the inclined state with the exhaust port 26 located below the intake port, and the rib 101 is projectingly provided on the upper surface of the rocker shaft holder 44 below the groove portion 98. Therefore, the rib 101 enhancing the rigidity of the rocker shaft holder 44 can function as the wall defining the lower portion of the oil sump 97, and a larger amount of the oil can be positively stored on the upper surface of the rocker shaft holder 44.

In addition, the rocker shaft holder 44 includes the bottomed cylindrical tubes 88 integrally provided on the upper surface thereof and having the lost motion springs 87 accommodated therein for biasing the free rocker arm 42 on the side of the exhaust valves VE, VE toward the cam 63 of the camshaft 35, and the rib 101 also integrally provided on the upper surface thereof to connect the bottomed cylindrical tubes 88 to one another, and a portion of the oil sump 97 is defined by the bottomed cylindrical tubes 88 and the rib 101. Therefore, it is possible to increase the rigidity of the rocker shaft holder 44 by the bottomed cylindrical tubes 88 and the rib 101, and to define a portion of the oil sump 97 in the upper surface of the rocker shaft holder 44. Particularly, as in the present embodiment, it is possible to further increase the rigidity of the rocker shaft holder 44 by interconnecting the bottomed cylindrical tubes 88 and the rib 101 to form a substantially U-shape.

The lubricating oil passages 100 are provided in the rocker shaft holder 44 in such manner that the upper ends of the lubricating oil passages 100 communicate with the oil sump 97 in the region surrounded by the bottomed cylindrical tubes 88 and the rib 101, and hence, the upper ends of the lubricating oil passages 100 communicate with the portions having the increased rigidity. Therefore, it is possible to avoid a reduction in rigidity of the rocker shaft holder 44 due to the provision of the lubricating oil passages 100.

The rib 102 is also projectingly provided on the upper surface of the rocker shaft holder 44 to extend in the direction of arrangement of the cylinders, so that the oil sump 97 is interposed between the ribs 101 and 102. The rigidity of the rocker shaft holder 44, and in turn the support rigidity of the rocker shafts 36 and 37 can be enhanced even by the rib 102.

Further, since the ribs 101 and 102 connect the shaft-supporting sections 44*a* and the shaft-supporting intermediate portions 44*c* in the rocker holder 44 to one another, it is possible to enhance the rigidity of the rocker shaft holder 44, particularly, the rigidity of the shaft-supporting intermediate portions 44*c* by the ribs 101 and 102, and in turn to further enhance the support rigidity of the rocker shaft 37.

The hydraulic pressure control valve unit 90 is mounted to the cylinder head 16 and capable of controlling the pressure of the working oil supplied to the valve-operating characteristic changing mechanism 65 provided in the rocker arms 38 to 40 on the intake valves VI, VI and the valve-operating characteristic changing mechanism 75 provided in the rocker arms 41 and 42 on the side of the exhaust valves VE, VE, and the drain oil discharged from the hydraulic pressure control valve unit 90 is guided to the oil sump 97. Therefore, the drain oil discharged from the hydraulic pressure control valve unit 90 can be also passed to the slide portions of the rocker arms 41 and 42 on the side of the exhaust valves VE, VE and utilized to lubricate the slide portions, and hence, it is unnecessary to provide other special lubricating oil passages. Moreover, the hydraulic pressure control unit 90 discharges only the drain oil upon the switching operation of the valve-operating characteristic changing mechanisms 65 and 75, and a reduction in pressure of the working oil supplied to the valve-operating characteristic changing mechanisms 65 and 75 cannot occur, and the responsiveness of the hydraulic pressure control valve unit 90 cannot be reduced, due to the utilization of the drain oil for the lubrication.

The passage-defining member 93 having the first and second communication passages 94 and 95 interconnecting the first working oil passages 73 and 83 and the second working oil passages 74 and 84 defined respectively in the rocker shafts 36 and 37 is interposed between the hydraulic pressure control valve unit 90 and the rocker shaft holder 44, and the upper portion of the passage-defining member 93 is formed to enable the delivery of the drain oil to the oil sump 97. Therefore, a part exclusively for delivering the drain oil between the hydraulic pressure control valve unit 90 and the oil sump 97 is not required.

Further, the upper portion of the passage-defining member 93 is provided with the recess 103 for receiving the drain oil from the hydraulic pressure control valve unit 90, and the guide 104 for guiding the drain oil accumulated in the recess 103 toward the oil sump 97. The guide 104 is extended from the passage-defining member 93 to above one end of the groove portion 98 of the oil sump 97. Therefore, the drain oil can be reliably delivered from passage-defining member 93 to the oil sump 97 in the rocker shaft holder 44, and a sufficient amount of the drain oil can be supplied to the oil sump 97 to perform the sufficient lubrication.

The bearing sections 43 are integrally provided on the cylinder head 16 in the above-described embodiment, but the present invention is also applicable to an internal combustion engine in which bearing sections separate from a cylinder head 16 are provided on the cylinder head 16. In addition, the passage-defining member 93 separate from the hydraulic pressure control valve unit 90 is interposed between the hydraulic pressure control valve unit 90 and rocker shaft holder 44 in the embodiment, but the passage-defining member may be provided integrally on the hydraulic pressure control valve unit 90 and in this case, the number of parts can be reduced.

Although the embodiment of the present invention has been described in detail, it will be understood that the present invention is not limited to the above-described embodiments, and various modifications in design may be made without departing from the spirit and scope of the invention defined in the claims.

What is claimed is:

1. A lubricating structure in an internal combustion engine, comprising a rocker shaft holder which comprises a plurality of shaft-supporting sections connected together and disposed at distances in a direction of arrangement of cylinders and which is fixed to a cylinder head; and rocker shafts each of which swingably carries thereon a plurality of rocker arms and which are supported by said shaft-supporting sections, wherein said rocker shaft holder has an oil sump defined on its upper surface, and has lubricating oil passages communicating with said oil sump so that a lubricating oil can be supplied to slide portions of at least some of said rocker arms, and wherein said oil sump is open at its upper surface to the outside.

2. A lubricating structure in an internal combustion engine according to claim 1, wherein said oil sump having a groove portion extending in the direction of arrangement of the cylinders is defined in the upper surface of said rocker shaft holder fixed to the cylinder head inclined to left or right in said direction of arrangement of the cylinders; said rocker shaft holder has a rib projectingly provided on its upper surface at a position below said groove portion to extend in the direction of arrangement of the cylinders; and said lubricating oil passages with their upper ends communicating with a portion of said oil sump closer to said rib are provided in said rocker shaft holder to extend through said rocker shaft holder along a side face of said rib adjacent said oil sump.

3. A lubricating structure in an internal combustion engine according to claim 2, further including valve-operating characteristic changing mechanisms provided in said rocker arms and capable of changing the valve-operating characteristic for engine valves by changing the hydraulic pressure, and a hydraulic control valve unit mounted to the cylinder head to be able to control the pressure of the working oil supplied to said valve-operating characteristic changing mechanisms so that a drain oil discharged from said hydraulic control valve unit is guided to said oil sump.

4. A lubricating structure in an internal combustion engine according to claim 1, wherein at least a portion of said oil sump defined in the upper surface of said rocker shaft holder fixed to the cylinder head inclined to left or right in said direction of arrangement of the cylinders is defined by a plurality of bottomed cylindrical tubes integrally provided on said rocker shaft holder with lost motion springs accommodated therein for biasing some of the rocker arms; and a rib integrally provided on said rocker shaft holder to connect said bottomed cylindrical tubes together at a lower side in a direction of inclination of the cylinder head, and said lubricating oil passages are provided in said rocker shaft holder with their upper ends communicating with said oil sump in a region surrounded by the plurality of bottomed cylindrical tubes and said rib.

5. A lubricating structure in an internal combustion engine according to claim 4, further including valve-operating characteristic changing mechanisms provided in said rocker arms and capable of changing the valve-operating characteristic for engine valves by changing the hydraulic pressure, and a hydraulic control valve unit mounted to the cylinder head to be able to control the pressure of the working oil supplied to said valve-operating characteristic changing mechanisms so that a drain oil discharged from said hydraulic control valve unit is guided to said oil sump.

6. A lubricating structure in an internal combustion engine according to claim 1, further including valve-operating characteristic changing mechanisms provided in said rocker arms and capable of changing the valve-operating characteristic for engine valves by changing the hydraulic pressure, and a hydraulic control valve unit mounted to the cylinder head to be able to control the pressure of the working oil supplied to said valve-operating characteristic changing mechanisms so that a drain oil discharged from said hydraulic control valve unit is guided to said oil sump.

7. A lubricating structure in an internal combustion engine according to claim 1, further including valve-operating characteristic changing mechanisms provided in said rocker arms and capable of changing the valve-operating characteristic for engine valves by changing the hydraulic pressure, and a hydraulic control valve unit mounted to the cylinder head for controlling the pressure of the working oil supplied to working oil passages defined in said rocker shafts to lead to said valve-operating characteristic changing mechanisms, and wherein said oil sump enabling the drain oil to flow from said hydraulic pressure control valve unit is defined in the upper surface of the rocker shaft holder so that the lubricating oil can be supplied to the slide portions of at least some of said rocker arms.

8. A lubricating structure in an internal combustion engine according to claim 7, further includes a passage-defining member interposed between said hydraulic pressure control valve unit and said rocker shaft holder, and having communication passages interconnecting said hydraulic pressure control valve unit and said working oil passages, an upper portion of said passage-defining member being formed to be able to deliver the drain oil discharged from said hydraulic pressure control valve unit to said oil sump.

9. A lubricating structure in an internal combustion engine according to claim 8, wherein the upper portion of said passage-defining member is provided with a recess adapted to receive the drain oil from said hydraulic pressure control valve unit, and a guide for guiding the drain oil accumulated in said recess toward said oil sump, said guide being extending from said passage-defining member to above said oil sump.

10. A lubricating structure in an internal combustion engine according to claim 1, wherein an upper portion of the oil sump is open to the outside.

11. A lubricating structure in an internal combustion engine comprising rocker shafts each of which swingably carries thereon a plurality of rocker arms and which are supported on a rocker shaft holder fixed to a cylinder head, valve-operating characteristic changing mechanisms provided in said rocker arms and capable of changing the operating characteristic for engine valves by changing the hydraulic pressure, and a hydraulic pressure control valve unit mounted to the cylinder head for controlling the pressure of a working oil supplied to working oil passages defined in said rocker shafts to lead to said valve-operating characteristic changing mechanisms, wherein said rocker shaft holder has an oil sump defined in its upper surface to enable a drain oil from said hydraulic pressure control valve unit to flow so that a lubricating oil can be supplied to slide portions of at least some of said rocker arms, and wherein said oil sump is open at its upper surface to the outside.

12. A lubricating structure in an internal combustion engine according to claim 11, further including a passage-defining member interposed between said hydraulic pressure control valve unit and said rocker shaft holder, and having communication passages interconnecting said hydraulic pressure control valve unit and said working oil passages, an upper portion of said passage-defining member being formed to be able to deliver the drain oil discharged from said hydraulic pressure control valve unit to said oil sump.

13. A lubricating structure in an internal combustion engine according to claim 12, wherein the upper portion of the passage-defining member is provided with a recess adapted to receive the drain oil from said hydraulic pressure control valve unit, and a guide for guiding the drain oil accumulated in said recess toward said oil sump, said guide being extending from said passage-defining member to above said oil sump.

14. A lubricating structure in an internal combustion engine according to claim 11, wherein an upper portion of the oil sump is open to the outside.

* * * * *